US007562643B2

(12) United States Patent
Akasaka

(10) Patent No.: US 7,562,643 B2
(45) Date of Patent: Jul. 21, 2009

(54) VALVE MECHANISM LIFT ADJUSTMENT DEVICE AND METHOD

(75) Inventor: Yuuzou Akasaka, Yokohama (JP)

(73) Assignee: Nissan Motor Co., Ltd., Yokohama-shi, Kanagawa (JP)

( * ) Notice: Subject to any disclaimer, the term of this patent is extended or adjusted under 35 U.S.C. 154(b) by 479 days.

(21) Appl. No.: 10/573,769

(22) PCT Filed: Nov. 15, 2005

(86) PCT No.: PCT/IB2005/003423

§ 371 (c)(1),
(2), (4) Date: Mar. 29, 2006

(87) PCT Pub. No.: WO2006/054147

PCT Pub. Date: May 26, 2006

(65) Prior Publication Data

US 2008/0053387 A1 Mar. 6, 2008

(30) Foreign Application Priority Data

Nov. 17, 2004 (JP) ..... 2004-332623

(51) Int. Cl.
*F01L 1/34* (2006.01)

(52) U.S. Cl. ..... 123/90.16; 123/90.39; 74/569

(58) Field of Classification Search ..... 123/90.15, 123/90.16, 90.17, 90.18, 90.2, 90.27, 90.31, 123/90.39, 90.44, 193.3, 193.5; 74/559, 74/567, 569
See application file for complete search history.

(56) References Cited

U.S. PATENT DOCUMENTS

| | | | | |
|---|---|---|---|---|
| 6,439,178 | B1 * | 8/2002 | Pierik | 123/90.16 |
| 6,736,096 | B2 * | 5/2004 | Pierik | 123/90.16 |
| 2002/0062801 | A1 | 5/2002 | Shimizu | |
| 2002/0088415 | A1 | 7/2002 | Pierik | |
| 2002/0088418 | A1 | 7/2002 | Pierik | |
| 2003/0226531 | A1 | 12/2003 | Miyazato et al. | |

FOREIGN PATENT DOCUMENTS

| | | |
|---|---|---|
| EP | 1338765 | 8/2003 |
| EP | 1365116 | 11/2003 |
| JP | 2001-123809 | 5/2001 |
| JP | 2006-105082 A | 4/2006 |

* cited by examiner

*Primary Examiner*—Ching Chang
(74) *Attorney, Agent, or Firm*—Young Basile

(57) ABSTRACT

Rotating drive shaft is connected to a crankshaft and valve cam. Valve cam lifts intake and exhaust valves that are linked by a plurality of links. The amount of lift of intake and exhaust valves is adjusted by adjusting the position of a connector pin, that passes through two links and allows for their relative rotation. The adjustment of the connector pin is configured so that it is performed from single adjustment direction using prescribed adjustment tools.

15 Claims, 7 Drawing Sheets

VALVE MECHANISM LIFT ADJUSTMENT DEVICE AND METHOD

CROSS-REFERENCE TO RELATED APPLICATIONS

The present application is a national stage application under 35 U.S.C. § 371 based on International Application No. PCT/IB2005/003423, filed on Nov. 15, 2005, and claims priority under 35 U.S.C. § 119 of Japanese Patent Application No. 2004-332623, filed on Nov. 17, 2004, the entire content of which is expressly incorporated by reference herein.

FIELD

The present invention relates to technology that adjusts the amount of valve lift of one of intake or exhaust valves through adjustment of the position of a connector pin that connects two links of an internal combustion engine valve mechanism.

BACKGROUND

Japanese Patent Publication No. 2001-123809 describes a lift and operation angle varying mechanism that is one example of a variable valve mechanism for internal combustion engines of automobiles and the like, that can continuously modify intake or exhaust valve characteristics, i.e. valve lift amount and operation angle, to attain improvements in fuel economy at low speeds and output at high speeds. In this mechanism, a rotating drive shaft connected to a crankshaft is linked by a plurality of links to oscillating cams that are valve cams, which lift intake and exhaust valves so that the lift characteristics are changed by changing the position of the rocker arm, which is one of these links. In this kind of variable valve mechanism, variation in the amount of valve lift unavoidably occurs due to dimensional accuracy among multiple link connection points. In particular, when the amount of valve lift (operation angle) is in the ultra-small lift region of 1 mm or less for example, air intake volume will fluctuate comparatively widely due to small variations in the valve lift between cylinders, so there is a possibility that engine operability and stability could be hindered. Therefore, typical prior art mechanisms allow for the adjustment of the amount of the valve lift of intake and exhaust valves by providing a variable valve mechanism comprised of specific links that can be selected and replaced from among a plurality of links of differing dimensions and grades.

However, in this kind of method, the operation can sometimes be extremely difficult, depending on the position and direction of the portion of the adjustment tool that mates/inserts into the bolt. In general, there is limited space inside cylinder heads where many parts, such as valve mechanism links, are located, and therefore, if for example, the portion of the adjustment tool that mates/inserts into the bolt is located inside a cylinder head, the adjustment tool must be mated/inserted without interfering with the surrounding parts inside the cylinder head, making this operation extremely difficult at times, or essentially impossible, hence requiring further improvements.

SUMMARY

The present invention takes these types of issues into consideration and allows for adjustment of the valve lift amount without disassembling the valve mechanism by adjusting the position of the connector pin that connects two links comprising the valve mechanism, and has as its main purpose the achievement of adjustment time reduction and productivity improvement through the further simplification/increase in efficiency (automation) of this kind of lift adjustment.

DETAILED DESCRIPTION

Next, a detailed explanation of the most favorable configuration for the present invention is provided with reference to the figures.

If the valve lift amount is not within a prescribed range when the valve lift is measured with the variable valve mechanism in the assembled condition, the variable valve mechanism must be disassembled and the link(s) replaced, and reassembled so adjustment operation man-hours increase and work efficiency is poor. In addition, concerns regarding adjustment accuracy remain because assembly error occurs easily during link reassembly.

Therefore, valve lift adjustment without replacement of links is desirable. As one example of this, adjustment of the valve lift is conceivable by changing the position of a rotatable connector pin that connects to two links that comprise a variable valve mechanism. This can occur, for example, by forming a pin guide hole to which the connector pin could movably mate to one of the two links and the connector pin could be sandwiched and held by a pair of adjustable bolts. When adjusting the valve lift amount, the connector pin position would be adjusted by adjusting the bolts, using suitable adjustment tools such as a wrench, and by tightening the bolts after adjustment. Accordingly, the valve lift adjustment is possible without disassembling the valve mechanism.

The present invention pertains to a lift adjustment device for a valve mechanism that has a rotating driveshaft connected to a crankshaft and a valve cam that contacts and lifts intake or exhaust valves, wherein the valve mechanism is provided with a plurality of links that link the driveshaft and valve cam; a connector pin inserted into and connecting two of the plurality of links enabling relative rotation of both; and a means of lift adjustment in which the position of the connector pin is adjustable from a single direction using prescribed adjustment tools in order to adjust the amount of lift of the intake and exhaust valves.

The present configuration allows for lift adjustment performed by adjusting the position of the connector pin in this manner, resulting in improved work efficiency and adjustment accuracy without disassembling the valve mechanism to replace links as in the prior art described above. And, since the connector pin position adjustments performed by adjustment tools can be made from a single direction, there are few layout restrictions, and therefore adjustment operations can be performed easily without concerns about interference between adjustment tools and parts inside cylinder heads. Thus, automation of lift adjustment operations is achievable using a nut runner, or the like, provided as the adjustment tool, for example, and it is possible to dramatically improve productivity through reductions in operation time as well as improve adjustment accuracy through automatic adjustment.

Figure 1:
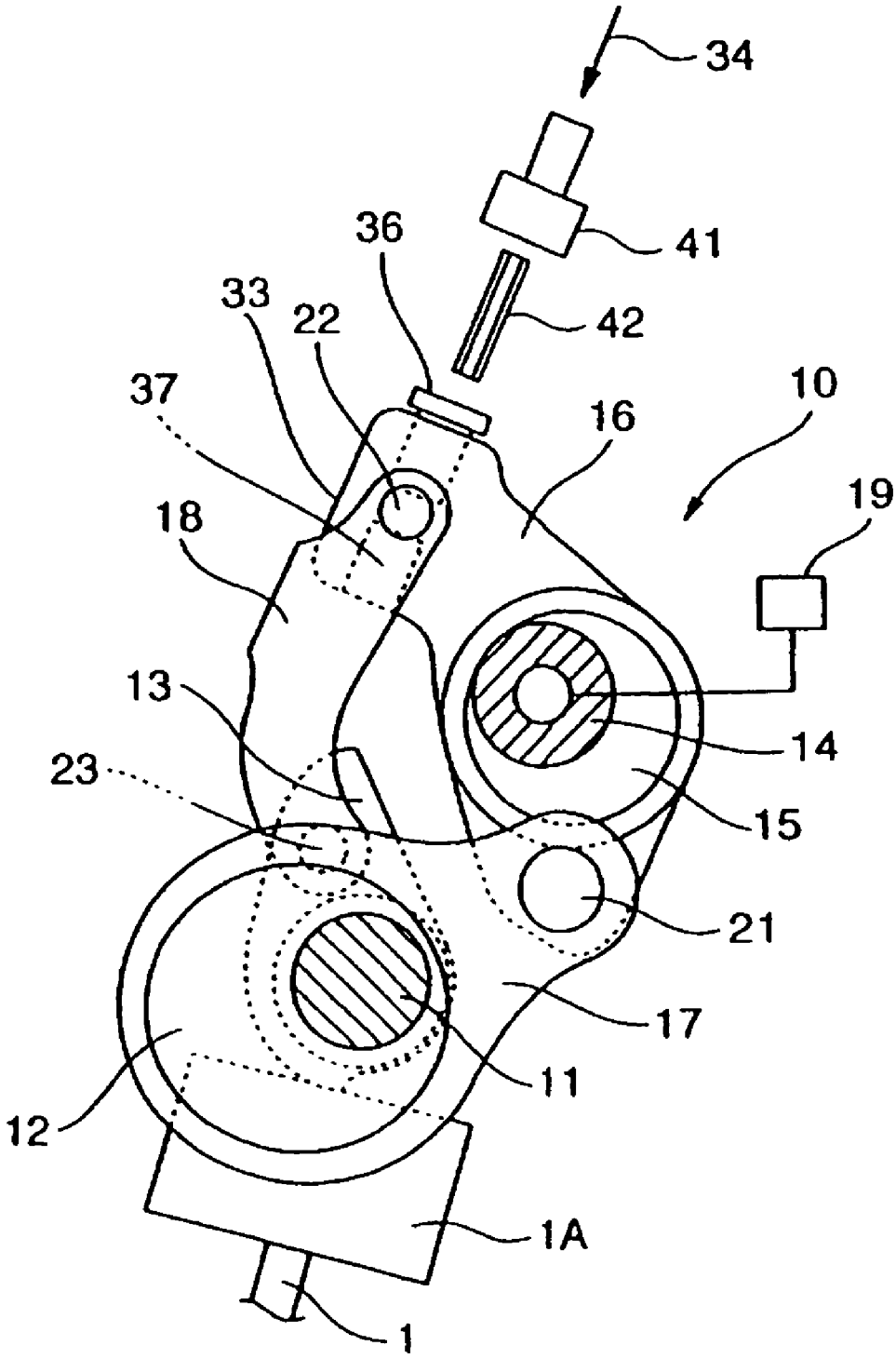
FIG. 1 is a front elevation view that shows a lift/operation angle varying mechanism as one embodiment of the valve mechanism to which the present invention applies.
Figure 2:
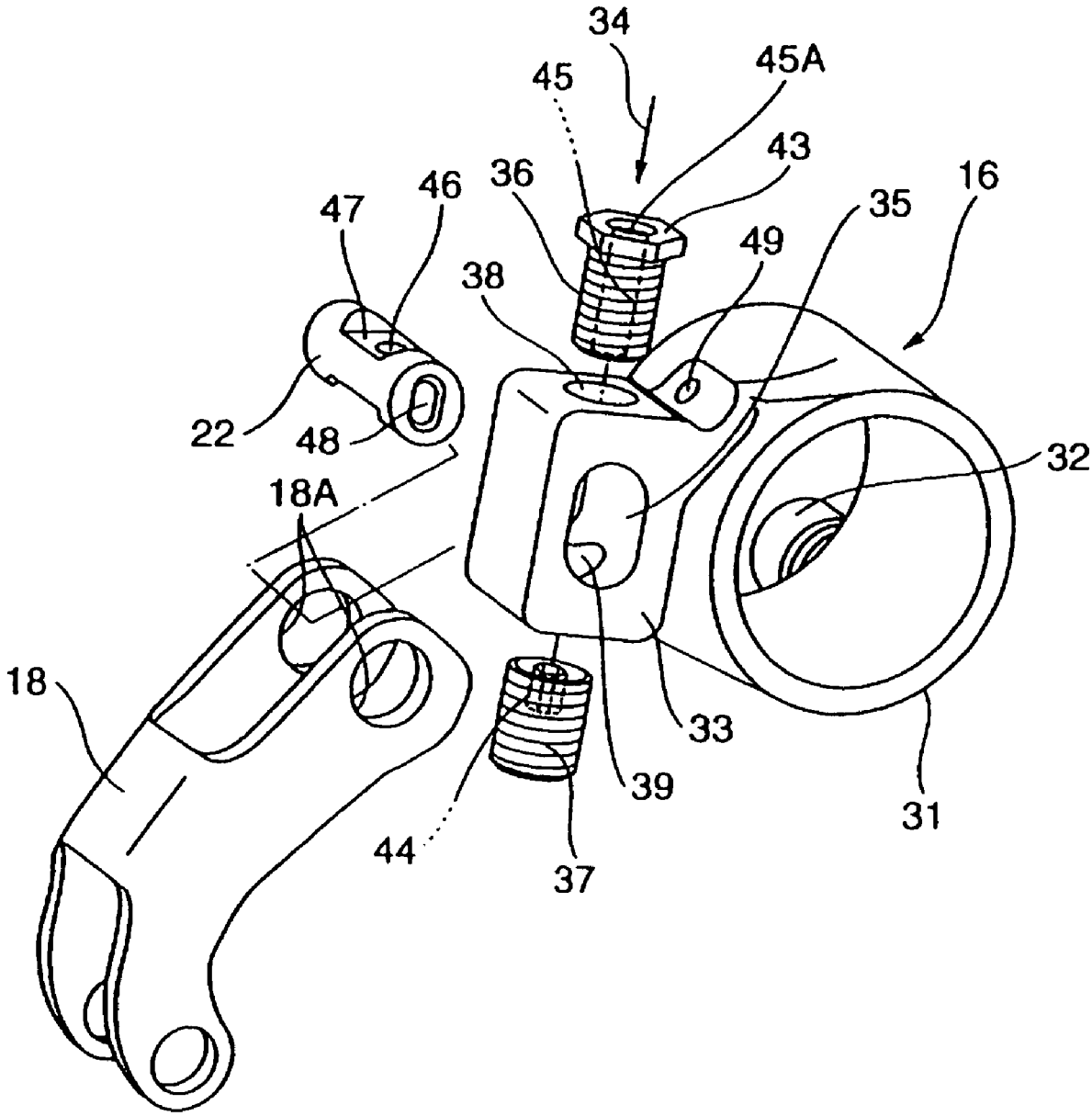
FIG. 2 is an exploded perspective view that shows the pin connection portion pertaining to one embodiment of the present invention.
Figure 3:
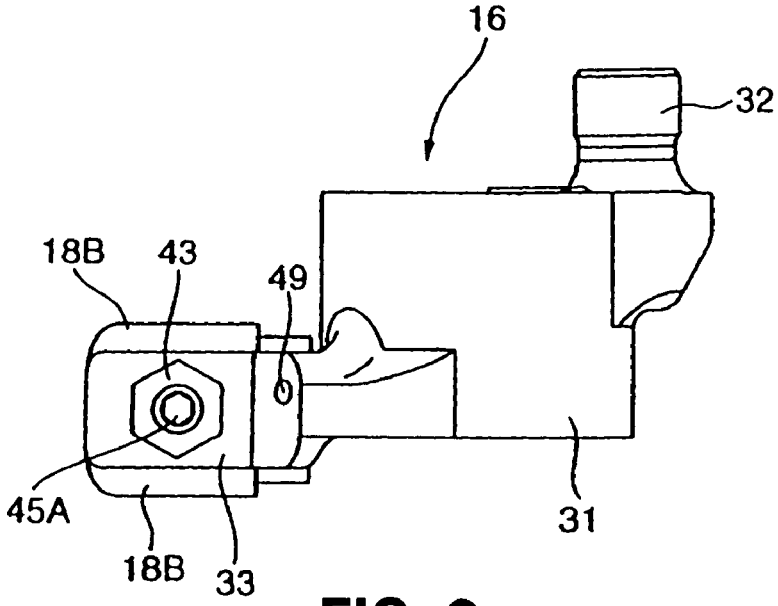
FIG. 3 is a top view of the pin connection portion shown in FIG. 2.
Figure 4:
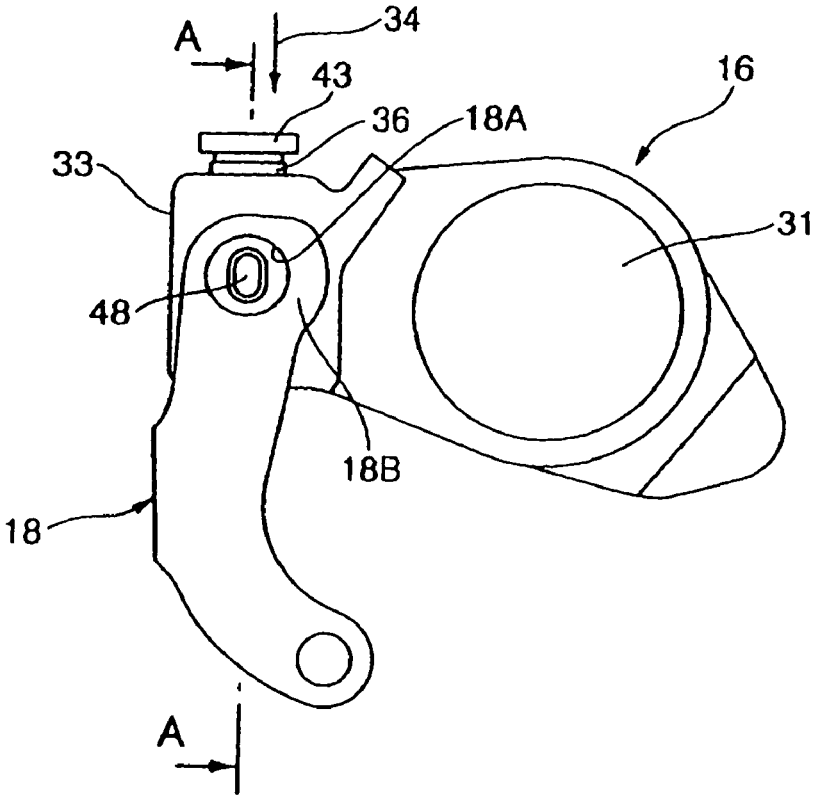
FIG. 4 is a front elevation view of the same pin connection portion shown in FIG. 2.
Figure 5:
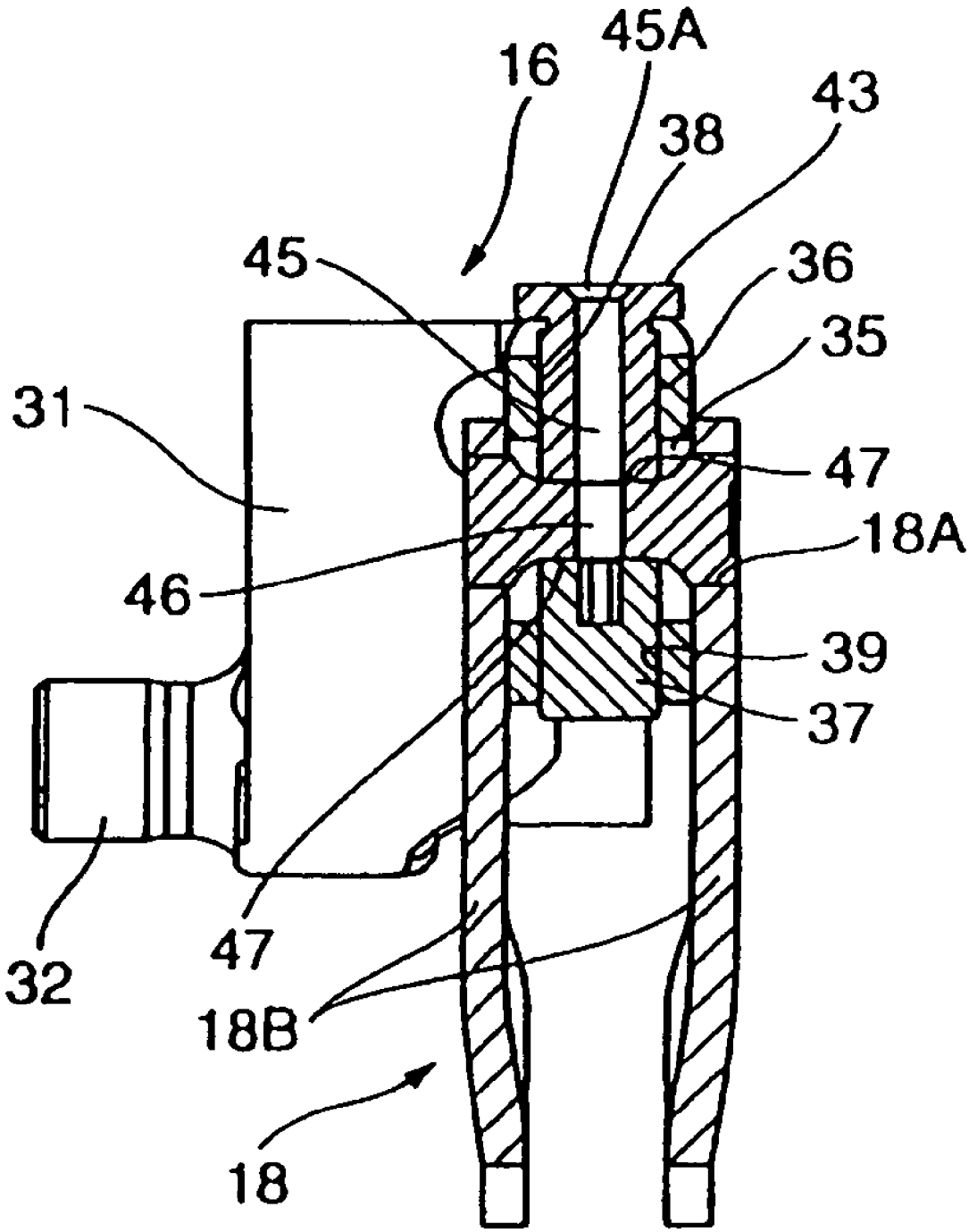
FIG. 5 is a cross-sectional view along line axis A-A of FIG. 4.

Next, a detailed explanation of the most favorable configuration for the present invention is provided with reference to the figures. As a favorable example of a valve mechanism applied in this invention, FIG. 1 shows lift/operation angle varying mechanism 10 that can continuously vary both the intake valve lift amount and the operation angle by opening and closing the intake valves.

Lift/operation angle varying mechanism 10 is comprised of a plurality of links that link rotating drive shaft 11 connected to a crankshaft, and oscillating cam 13 mated to drive shaft 11 such that the cam can oscillate and lift the intake valve. In short, lift/operation angle varying mechanism 10 is provided with eccentric drive portion 12 located eccentrically to drive shaft 11, control shaft 14 extending in the cylinder row direction parallel to drive shaft 11, eccentric control shaft portion 15 located eccentrically to the control shaft 14, rocker arm 16 mated to the eccentric control shaft portion 15 such that the rocker arm can oscillate, ring-shaped first link 17 that links eccentric drive shaft portion 12 and one end of rocker arm 16 and second link 18 that links the other end of rocker arm 16 and the front end of oscillating cam 13. First link 17 is mated so that it can rotate in the circular periphery of eccentric drive shaft portion 12. One end of rocker arm 16 and the front end of first link 17 are rotatably connected by first connector pin 21. The other end of rocker arm 16 and one end of second link 18 are rotatably connected by second connector pin 22. The other end of second link 18 and the front end of oscillating cam 13 are rotatably connected by third connector pin 23.

Figure 6:
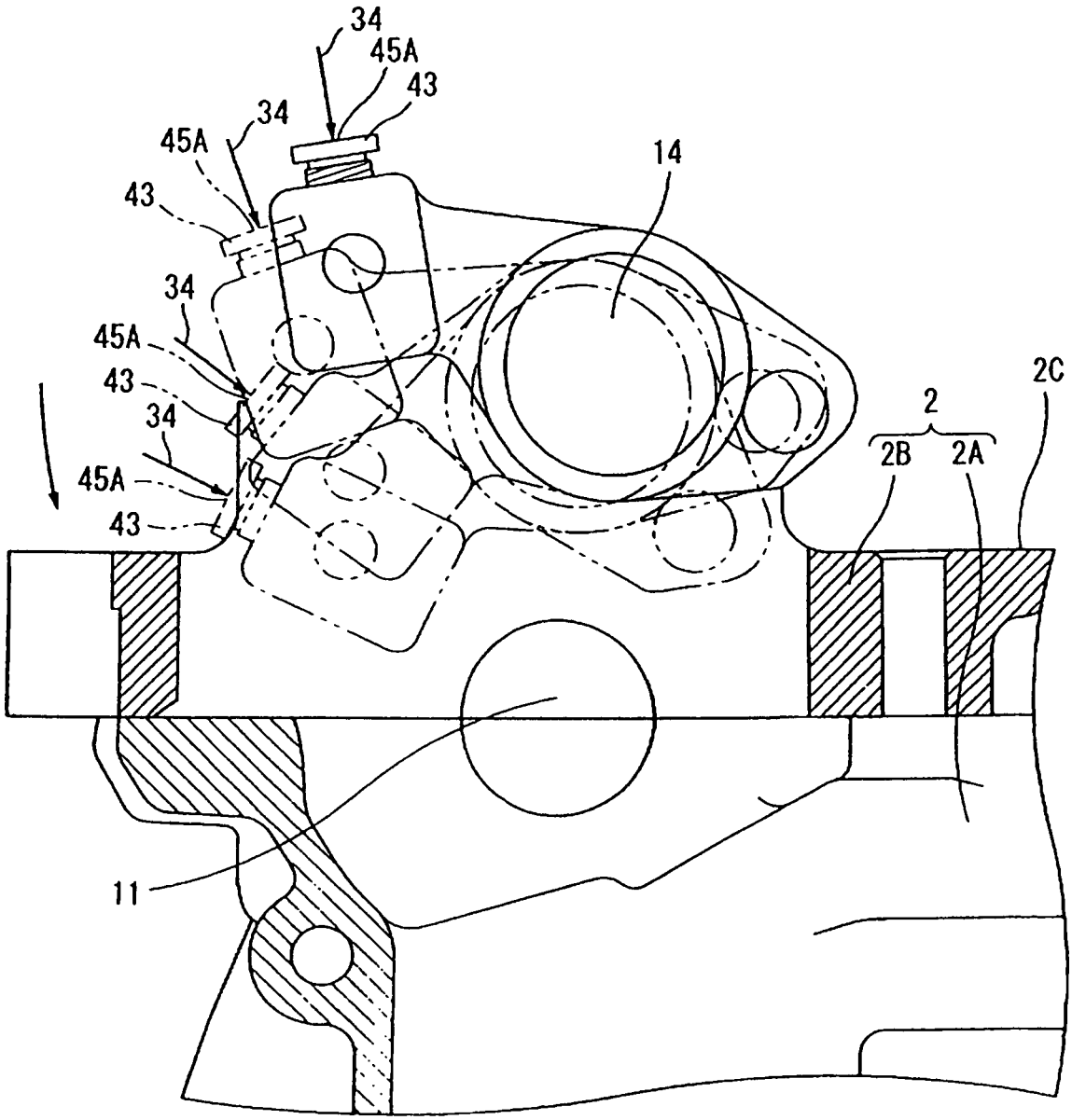
FIG. 6 is a schematic diagram that shows the layout for the pin connection portion in the engine-mounted condition.

Drive shaft 11 is connected to a crankshaft via a transmission mechanism not shown in the figure such as a chain or a pulley and moves rotationally connected to the crankshaft. Also, as shown in FIG. 6, drive shaft 11 extends in the cylinder row direction (perpendicular to the paper surface of FIG. 6) and is rotatably supported above cylinder head 2. Cylinder head 2 is comprised of head lower 2A, which sandwiches and holds rotatable drive shaft 11, and ladder-frame shaped head upper 2B, which consists of a plurality of integrated bearing caps and is fixed to the upper surface of head lower 2A. Further, drive shaft 11 and control shaft 14 are provided for a cylinder row comprised of a plurality of cylinders and are shared by all cylinders comprising the cylinder row. With respect to this, component parts 12, 13 and 15 through 23 for lift/operation angle varying mechanism 10 are provided for each of the cylinders that comprise the cylinder row.

Referring again to FIG. 1, oscillating cam 13, acting as a valve cam, is located above valve lifter 1A of each cylinder's intake valve 1. Similar to drive shaft 11, rotatable control shaft 14 is supported by cylinder head 2, and in addition, its rotation angle position is changed and maintained by operation angle actuator 19.

In terms of a brief explanation of the operation of this lift/operation angle varying mechanism 10, when driveshaft 11 is rotated, rocker arm 16 oscillates via eccentric drive shaft portion 12 and first link 17, the oscillation motion of this rocker arm 16 is transmitted via second link 18 to oscillating cam 13, and oscillating cam 13 oscillates. Oscillating cam 13 contacts valve lifter 1A provided above intake valve 1, and by pressing against this valve lifter 1A, intake valve 1 opens and closes, or in other words, lifts against the valve spring reactive force.

In addition, changing the rotational position of control shaft 14 by means of operation angle actuator 19 will change the center position of eccentric control shaft portion 15, which is the oscillation support point of rocker arm 16. By doing this, the range of oscillation for oscillating cam 13 varies, while the center phase of the operation angle of intake valve 1 remains nearly steady in relation to the crank angle (crankshaft rotational position). The size of the valve lift for intake valve 1 (maximum lift) and the operation angle will both vary continuously and smoothly (not in stages). The control status of this lift/operation angle varying mechanism 10 is detected, for example, by a control shaft sensor (lift sensor), which is an angle sensor that responds to the rotational position of control shaft 14.

This kind of lift/operation angle varying mechanism 10 enables continuous change of both valve lift and operation angle of intake valve 1 and provides the following kinds of unique interaction effects. Since most connecting points of each link element are surface contacts, lubrication is easy, and reliability and durability are superior. Because there is no need to use a biasing means such as return springs, the configuration is simple, and reliability and durability are superior. In addition, this mechanism 10 can be easily applied without major changes to layout with respect to internal combustion engines with direct acting valve systems because drive shaft 11 and oscillating cam 13 can be located in almost the same position as a preexisting direct acting valve system camshaft and fixed cam.

Furthermore, by using this kind of lift/operation angle varying mechanism 10, intake air volume can be widely adjusted without reliance on a throttle valve by using valve lift amounts in an extremely small lift range of 1 mm or less, for example, whereby so-called throttle loss can be greatly reduced or eliminated. However, in this kind of extremely small lift range, it is very important to accurately adjust the valve lift amount within a prescribed dimensional tolerance to effectively reduce or eliminate variation in the amount of valve lift between cylinders, because a miniscule amount of variation in valve lift between cylinders will result in comparatively large variation in intake air volume.

The amount of valve lift is adjusted in the present working example by adjusting the position of second connector pin 22 that connects second link 18 and rocker arm 16 that are the two links comprising the lift/operation angle varying mechanism 10.

FIGS. 2 through 5 show the pin connection portion of rocker arm 16 and second link 18 pertaining to the first working example of the present invention. Rocker arm 16 is comprised of main bearing portion 31 into which is rotatably mated eccentric control shaft portion 15, first pin mating portion 32 where first pin 21 mates and second pin mating portion 33 where second pin 22 mates, and items 31 through 33 are formed as one integrated piece with an appropriate metal material. The two pin mating portions 32 and 33 are formed ancillary to the outer periphery of main bearing portion 31, and in addition, are mutually offset in the axial direction of main bearing portion 31 to avoid interference.

In second pin mating portion 33 is formed pin guide hole 35 into which is movably mated first connector pin 22 along prescribed adjustment direction 34 in the radial direction of second connector pin 22. In short, pin guide hole 35 is penetration-formed in the axial direction of connector pin 22 so that it also forms a long slot in the adjustment direction 34.

The position of connector pin 22 is changed and maintained in adjustment direction 34 by a pair of holders, first holder 36 and second holder 37, that sandwich and hold connector pin 22 in the adjustment direction 34. Holder mating holes 38 and 39 into which holders 36 and 37 respectively mate are formed at pin mating portion 33. Each of holder mating holes 38 and 39 is formed along the adjustment direction 34, and in addition, one end of each opens to pin guide hole 35. Threaded portions are formed on the outer surfaces of holders 36 and 37 and the inner surfaces of holder mating holes 38and 39 that screw together. As described below, bolt-shaped holders 36 and 37 are turned with socket wrench 41 and hex wrench 42 used as adjustment tools (see FIG. 1), and the position of connector pin 22 is adjusted by loosening or tightening holders 36 and 37 through the threaded portions.

On first holder 36 at the edge of the opposite side of pin guide hole 35 is formed bolt head 43 as the first tool mating portion that mates to socket wrench 41, which is used as the first adjustment tool that turns first holder 36. Bolt head 43 has a polygonal shape such as the hexagonal shape pictured. On second holder 37 is formed tool mating hole 44 as a second tool mating portion that mates to hex wrench 42, which is used as the second adjustment tool that turns second holder 37. This tool-mating hole 44 is an elongated hole with a hex-shaped cross-section that matches hex wrench 42, and the hole 44 extends in the adjustment direction with one end opening to the end of pin mating hole 35. Furthermore, tool insertion holes 45 and 46 that enable insertion of the hex wrench are penetration-formed in first holder 35 and connector pin 22. These tool insertion holes 45 and 46 are set with a larger diameter than hex wrench 42 and tool-mating hole 44.

Seat surface 47, whose surface comes into contact with flat end surfaces of holders 36 and 37, are formed on the periphery of connector pin 22 so that these tool insertion holes 45 and 46 are arranged on the same axis line in adjustment direction 34, in other words, in order to locate the rotational position of the connector pin with respect to pin mating portion 33; and in addition, a locator slot 48 is formed on the periphery of connector pin 22 to check and adjust the rotational position of connector pin 22. Reference symbol 49 is an oil hole for supplying lubrication oil to the bearing surface of main bearing portion 31.

In second link 18, two-pronged portion 18B is formed by pin holes 18A, which are rotatably mated to connector pin 22; pin mating portion 33 is placed between two-pronged portion 18B; and by inserting connector pin 22 into pin holes 18A and the pin guide hole 35, second link 18 and rocker arm 16 become rotatably connected.

Since connector pin 22 is securely fixed and held to pin mating portion 33 by holders 36 and 37 when assembled, as illustrated in the second embodiment shown in FIG. 8, which is explained below, a retaining head and flange that protrude further than the axial direction of second link 18 are not provided at both ends of connector pin 22 so that both ends of connector pin 22 are positioned nearly flush with side surfaces of second link 18, resulting in reduction of weight and size.

Figure 7:
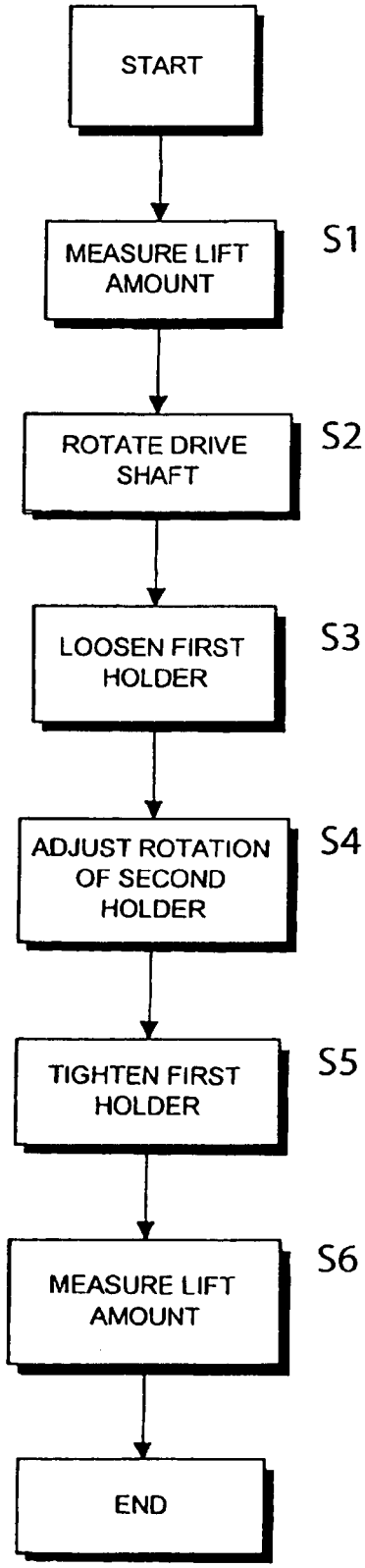
FIG. 7 is a flowchart that shows the flow of the valve lift adjustment process for the lift/operation angle mechanism.

FIG. 7 is a flow chart showing the valve lift adjustment procedure for the valve mechanism 10. In step 1 ("step" is abbreviated as "S" in the figure), the amount of valve lift of the plurality of cylinders comprising a cylinder row is measured. Specifically, the amount of valve lift of each cylinder is measured with each component part of valve mechanism 10 in the assembled condition.

Next, in step 2, control shaft 14 is set in a prescribed minimum lift position, and drive shaft 11 is set in a prescribed rotational position wherein all cylinders comprising a cylinder row have essentially no lift. Also, when the maximum valve lift amount is essentially 0 ("zero") at the minimum lift position, the valve lift amount of all cylinders will be 0; regardless of the rotational position of the drive shaft. In step 3, first holder 36 is loosened with socket wrench 41. In step 4, based on the measurement results from step 1, second holder 37 is turned by hex wrench 42, the position of connector pin 22 is adjusted, and the amount of valve lift is adjusted. In step 5, first holder 36 is tightened with socket wrench 41, and the position of connector pin 22 is fixed and held in the post-adjustment position. Next, in step 6, the amount of valve lift is measured again to confirm that the adjustment was done correctly. If the adjustment is insufficient, the aforementioned adjustment operation is repeated. The series of adjustment operations is completed when the correct adjustment has been confirmed. This type of series of adjustment operations is automated by a nut runner, or the like, that provides socket wrench 41 and hex wrench 42 on the same axis so adjustment operations can be performed accurately and efficiently in a short amount of time.

In the present working example, the adjustment of the position of connector pin 22 using adjustment tools 41 and 42 is performed in the same, single direction, or adjustment direction 34. Specifically, the direction in which socket wrench 41 mates with head portion 43 of first holder 36, and the direction in which hex wrench 42 is inserted into opening 45A of tool insertion hole 45 are set on the same axis line along adjustment direction 34.

Figure 8:
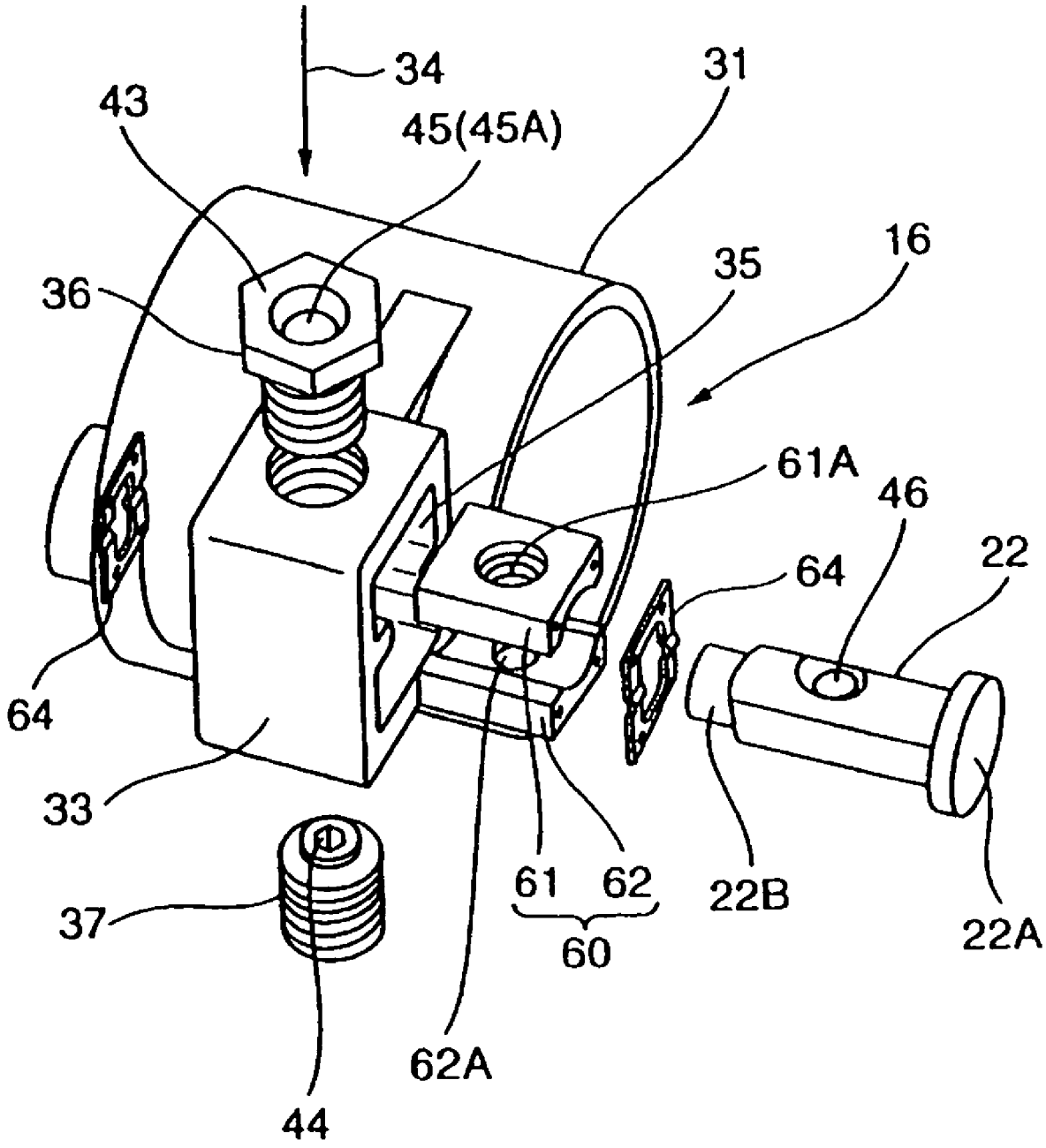
FIG. 8 is an exploded perspective view that shows the pin connection portion pertaining to the second working example of the present invention.

FIG. 8 shows an adjustment device pertaining to the second working example of the present invention. The second working example varies greatly from the first working example in that bearing 60 is provided that rotatably supports connector pin 22. The structures in common with working example 1 bear the same reference symbols, so duplicate explanation is omitted accordingly. Bearing 60 has a halved structure wherein each half part 61 and 62 is placed between holders 36 and 37 and connector pin 22, rotatably supports connector pin 22 and movably mates into pin guide hole 35 with connector pin 22 in adjustment direction 34. In each half part 61 and 62, tool insertion holes 61 A and 62A are penetration-formed, through which hex wrench 42 is inserted, similar to the tool insertion holes 45 and 46. Also, to prevent connector pin 22 from becoming detached, large diameter head portion 22A is formed on one end of connector pin 22, and on the other end 22B, a large diameter flange (not shown in the Figure) is mated. Washer-shaped leaf springs 64 are inserted between both ends of bearing 46 and the sides of the second link in an axial direction.

The characteristic structures and effects of the working examples related to the present invention are listed below.

The present invention is comprised of a valve mechanism (10) connected by a plurality of links, 16 through 18, to valve cam 13 that contacts and lifts intake/exhaust valves and rotating drive shaft 11 connected to a crankshaft. It is also comprised of connector pin 22, inserted into two of the plurality of links 16 through 18 (16, 18) comprising this valve mechanism 10 and enables their relative rotation, and a lift adjustment means to adjust intake and exhaust valve lift amount wherein the position of connector pin 22 is adjustable from a single direction (adjustment direction 34) using prescribed adjustment tools 41 and 42.

Since lift adjustment operations performed by adjusting the position of the connector pin in such a manner eliminate the need to disassemble the valve mechanism in order to adjust the lift, as in the aforementioned prior art, operation man-hours and time are greatly reduced, and adjustment accuracy is also superior. In addition, adjustment of the position of connector pin 22 using adjustment tools 41 and 42 can be made from single adjustment direction 34. In other words, the mating and insertion direction of both adjustment tools 41 and 42 are set in the same adjustment direction 34. Therefore, as described below, by providing adjustment tools 41 and 42 that can easily be inserted and mated in adjustment direction 34 without interfering with surrounding parts, the previously described series of adjustment operations can be automated through a nut runner set up on the same axis as socket wrench 41 and hex wrench 42, which are used as adjustment tools; adjustment accuracy improves through automatic adjustments; and in addition, operation man-hours and time are greatly reduced and operation efficiency and productivity can be dramatically improved.

Hypothetically speaking, if the adjustment directions based on the adjustment tools, namely, insertion and mating directions, were different, it would be extremely difficult to set both of the adjustment directions so that insertion and mating of both of the adjustment tools could be done easily without interfering with surrounding parts, and it would be very difficult to automate adjustment operations as shown in the present working examples.

Generally in drive mechanisms, drive shaft 11, rotatably supported above cylinder head 2, is provided as a cylinder row comprised of a plurality of cylinders, and valve mechanism 10 is provided for each of the plurality of cylinders that comprise a cylinder row. Thus, depending on the rotational position of drive shaft 11, the position and orientation of adjustment direction 34 will vary at the plurality of cylinders that comprise the cylinder row.

FIG. 6 is a schematic diagram that shows the entire connector pin 22 vicinity of each of the drive mechanisms provided for each of four cylinders comprising a cylinder row, with drive shaft 11 set in the prescribed rotational position, as shown in step 2 of FIG. 7, in other words, in the condition to carry out the position adjustment of connector pin 22 as shown in steps 3 through 5 of FIG. 7. As shown in the same figure, the section where adjustment tools 41 and 42 are mated and inserted for all cylinders comprising a cylinder row, specifically, bolt head portion 43, to which socket wrench 41 mates, and opening 45A of tool insertion hole 45, into which hex wrench 42 is inserted, are positioned higher in the engine (toward the top of FIG. 6) than upper surface 2C of cylinder head 2 (head upper 2B). In other words, when in full operation, tool mating/insertion portions 43, 45A are configured so that they are not positioned below the upper surface 2C of cylinder head 2.

There are numerous parts inside cylinder head 2 positioned below upper surface 2C of cylinder head 2, such as links, that comprise valve mechanism 10, and since there is limited space, hypothetically speaking, if portions 43 and 45A, where adjustment tools mate and are inserted, intrude inside the cylinder head below upper surface 2C of cylinder head 2, operations to mate and insert adjustment tools in this portion will become difficult, and automatic lift adjustment may no longer be possible. Due to this, since in the working example, portions 43 and 45A, where adjustment tools mate and are inserted, are positioned above upper surface 2C of cylinder head 2 where there is comparatively more room, the automatic lift adjustment can be reliably achieved with valve mechanism 10 in the assembled engine-mounted condition in an internal combustion engine.

In other words, single adjustment direction 34, which is the direction of insertion of tools 41 and 42, is provided in a range such that the direction is oriented essentially from upper engine to lower engine at all cylinders comprising a cylinder row. Thus, the automatic lift adjustment can be reliably achieved because adjustment tools 41 and 42 can be inserted and mated from above cylinder heads, where there is more room, without encountering interference with surrounding parts.

As a specific example of adjustment from a single direction using the adjustment tools, pin guide hole 35 is formed for connector pin 22, which is movably mated in prescribed adjustment direction 34 along the radial direction at pin mating portion 33 on one of the two links. The position of connector pin 22 is adjusted by adjusting a pair of holders, first holder 36 and second holder 37, that sandwich and hold connector pin 22 in the adjustment direction 34. Also, the configuration is such that positional adjustment of first and second holders 36 and 37 is performed from a single direction, or adjustment direction 34.

More specifically, first and second holder mating holes 38 and 39 are formed that extend along the adjustment direction at pin mating portion 33, with one end of each open to the pin mating hole 35, and into which the first and second holders 36 and 37 are screwed. First tool mating portion 43 is formed at one end of first holder 36 to which first adjustment tool 41, such as a socket wrench, mates and rotates first holder 36. Second tool mating portion 44 is formed at one end of second holder 37 to which second adjustment tool 42, such as a hex wrench, mates and rotates second holder 37. Tool insertion holes 45 and 46 are penetration-formed to allow the second adjustment tool 42 to be inserted through the first holder 36 and connector pin 22.

According to the configurations described above, the position of the connector pin can be adjusted with a relatively simple structure that uses two holders (bolts) 36 and 37, thus allowing for a reduction in size and weight, higher reliability and easier assembly operations.

Preferably, as in the second working example shown in FIG. 8, a bearing 60 is provided, located between holders 45 and 46 and connector pin 22, that rotatably supports the connector pin 22 and at the same time mates with pin guide hole 35 and is moveable in adjustment direction 34 together with the connector pin 22. In this case, since connector pin 22 can be moved in the adjustment direction while being rotated axially by bearing 60, the pin connection portion of connector pin 22 can have a so-called full-floating connection structure, allowing for improved wear resistance and reliability.

A typical example of the varying mechanism is lift/operation angle varying mechanism 10 that can continuously change the valve lift and operation angle of intake and exhaust valves. This lift/operation angle varying mechanism 10 is provided with an eccentric drive shaft portion 12 located eccentrically to drive shaft 11, control shaft 14, eccentric control shaft portion 15 located eccentrically to control shaft 14, rocker arm 16 rotatably supported by eccentric control shaft portion 15, first link 17 that links one end of the rocker arm and the eccentric drive shaft portion, second link 18 that links the other end of rocker arm 16 and the valve cam 13, and actuator 19 that changes and maintains the rotational position of control shaft 14 to adjust the lift characteristics of the intake and exhaust valves. The present invention applies to connector pin 22, which is rotatably connected to rocker arm 16 and second link 18, for example.

By using this kind of lift/operation angle varying mechanism 10, intake air volume can be adjusted without reliance on a throttle valve because valve lift and operation angle of intake and exhaust valves can be continuously adjusted, and throttle loss can be greatly reduced or eliminated. On the other hand, miniscule variation in the amount of lift between cylinders tends to cause relatively large fluctuations in intake air volume, particularly when valve lift amounts are in an extremely small lift range. Therefore, it is very important to adjust the aforementioned lift amount within prescribed dimensional tolerances.

The lift adjustment method pertaining to the present invention is characterized by step 1 in which the valve lift amount is measured with the valve mechanism in the assembled state, and steps 2 through 4 in which, based on the results of the valve lift measurement, drive shaft 11 is set in a prescribed rotational position and intake and exhaust valve lift amounts are adjusted by adjusting the connector pin position from a single direction using prescribed adjustment tools.

The present invention has been explained based on specific working examples, but it is not limited to the working examples, and includes various modifications and alterations that do not fall beyond the scope of its intent. For example, the aforementioned working examples apply to a valve mechanism at the intake air valve side, but the present invention could also apply to a valve mechanism at the exhaust valve side. In addition, the working examples apply the present invention to an in-line 4 cylinder internal combustion engine, but the present invention can also be applied to other types of multiple cylinder internal combustion engines, such as in-line or V-type 6 cylinder and 8 cylinder engines and the like.

CONCLUSION

Although specific embodiments have been illustrated and described herein, it will be appreciated by those of ordinary skill in the art that any arrangement, which is calculated to achieve the same purpose, may be substituted for the specific embodiment shown. This application is intended to cover any adaptations or variations of the present invention. Therefore, it is manifestly intended that this invention be limited only by the claims and the equivalents thereof.

What is claimed:

1. A lift adjustment device for a valve mechanism connected by a plurality of links to a valve cam that contacts and lifts intake/exhaust valves and a rotating drive shaft connected to a crankshaft, the device comprising:

a connector pin, inserted into two of the plurality of links, that connects both links and allows for their relative rotation;

a lift adjustment means wherein the connector pin position is adjustable from a single direction using a prescribed adjustment tool; and a pin guide hole into which the connector pin, which is radially moveable in a prescribed adjustment direction, mates at a pin mating portion on one of the two links; and the lift adjustment means that is provided with a pair of holders, first holder and second holder, that sandwich and hold the connector pin in the prescribed adjustment direction, with the position of the connector pin being adjusted by adjusting the first holder and second holder wherein a configuration in which positional adjustment of the first holder and second holder is performed from the single direction.

2. The valve mechanism lift adjustment device described in claim 1, wherein the drive shaft is rotatably supported above cylinder heads and provides for each cylinder row, comprised of a plurality of cylinders, and the valve mechanism provided for each of the plurality of cylinders that comprise a cylinder row such that portions into which the adjustment tools mate or are inserted into a link are set at a position that is higher than an upper surface of the cylinder heads for all cylinders comprising a cylinder row, at least when the drive shaft is in a prescribed rotational position.

3. The valve mechanism lift adjustment device described in claim 2 wherein the drive shaft provided for a cylinder row, comprised of a plurality of cylinders and the valve mechanism provided for each of a plurality of cylinders that comprise a cylinder row wherein the single direction provided such that the direction is oriented essentially from upper engine to lower engine for all cylinders comprising a cylinder row, at least when the drive shaft is in a prescribed rotational position.

4. A lift adjustment device for a valve mechanism connected by a plurality of links to a valve cam that contacts and lifts intake/exhaust valves and a rotating drive shaft connected to a crankshaft, the device comprising:

a connector pin, inserted into two of the plurality of links, the connects both links and allows for their relative rotation;

a lift adjustment means wherein the connector pin position is adjustable from a single direction using a prescribed adjustment tool;

first and second holder mating holes that extend along an adjustment direction at a pin mating portion, with an end open to a pin guide hole, and into which the first and second holders are screwed;

a first tool-mating portion formed at one end of the first holder to which first adjustment tool mates and turns the first holder; and a second tool-mating portion formed at one end of the second holder to which second adjustment tool mates and turns the second holder wherein tool insertion holes penetration-formed to allow the second adjustment tool to be inserted through the first holder and the connector pin.

5. The valve mechanism lift adjustment device described in claim 4 and further comprising a bearing, placed between the holders and connector pin, that rotatably supports the connector pin, and at the same time mates with the pin guide hole and is moveable in the adjustment direction together with the connector pin.

6. A lift adjustment device for a valve mechanism connected by a plurality of links to a valve cam that contacts and lifts intake/exhaust valves and a rotating drive shaft connected to a crankshaft, the device comprising:

a connector pin, inserted into two of the plurality of links, that connects both links and allows for their relative rotation; and a lift adjustment means wherein the connector pin position is adjustable from a single direction using a prescribed adjustment tool;

an eccentric drive shaft portion located eccentrically to the drive shaft, a control shaft, an eccentric control shaft portion located eccentrically to the control shaft, a rocker arm rotatably supported to the eccentric control shaft portion, a first link that links one end of the rocker arm and the eccentric drive shaft portion, a second link that links the other end of the rocker arm and the valve cam, and an actuator that changes and maintains the rotational position of the control shaft to adjust the valve lift characteristics of the intake and exhaust valves wherein the connector pin is rotatably connected to the rocker arm and the second link.

7. A lift adjustment device for a valve mechanism connected by a plurality of links to a valve cam that contacts and moves intake/exhaust valves and a rotating drive shaft connected to a crankshaft, the device comprising:

a connector pin, insertable into a first and a second link of the plurality of links, that connects both links and allows for their relative rotation, the connector pin having an opening;

a threaded first holder that is insertable into a first threaded hole of the first link under and immediately adjacent to the connector pin, the first holder having an opening adapted to accept an adjustment tool, the first holder opening substantially aligning with the connector pin opening when the first holder is screwed into the first threaded hole; and a threaded second holder comprising an opening that extends the length of the second holder, the second holder insertable into a second threaded hole of the first link above and adjacent to the connector pin such that the second holder opening aligns with the connector pin opening and the first holder opening allowing insertion of the adjustment tool through the second holder.

8. The lift adjustment device described in claim 7 wherein the adjustment tool is adapted to turn the first holder within the first threaded hole to adjust the connector pin position in the first link thereby changing a position of the second link with respect to the first link.

9. The lift adjustment device described in claim 7 wherein the connector pin is movable in a first direction in the first link but substantially immovable in the first direction in the second link.

10. The lift adjustment device described in claim 7 wherein the second holder is adapted to be screwed into the second threaded hole to contact the connector pin after lift adjustment has been made.

11. The lift adjustment device described in claim 7 wherein the connector pin further comprises a first seat surface that contacts the first holder and a second seat surface that contact the second holder.

12. The lift adjustment device described in claim 7 wherein the first link further comprises a bearing portion into which a control shaft portion can be rotatably mated.

13. The lift adjustment device described in claim 12 wherein the bearing portion further comprises an oil hole for admitting lubrication for the bearing surface.

14. The lift adjustment device described in claim 7 wherein the threaded second holder further comprises a bolt head that is adapted to be turned by a wrench.

15. The lift adjustment device described in claim 7 wherein the first holder is adapted to be screwed further into the first link, in response to the adjustment tool, to move the connector pin in a first direction in the first link.

* * * * *